US010561578B2

(12) United States Patent
Kal

(10) Patent No.: US 10,561,578 B2
(45) Date of Patent: Feb. 18, 2020

(54) TUNING FORK HANDLE ASSEMBLY

(71) Applicant: Jason Francis Kal, Berkeley, CA (US)

(72) Inventor: Jason Francis Kal, Berkeley, CA (US)

( * ) Notice: Subject to any disclaimer, the term of this patent is extended or adjusted under 35 U.S.C. 154(b) by 386 days.

(21) Appl. No.: 15/170,225

(22) Filed: Jun. 1, 2016

(65) Prior Publication Data

US 2017/0348185 A1 Dec. 7, 2017

(51) Int. Cl.
*A61H 39/04* (2006.01)

(52) U.S. Cl.
CPC ..... *A61H 39/04* (2013.01)

(58) Field of Classification Search
CPC ..... A61H 2201/1685; A61H 39/04; A61H 23/004; A61H 99/00
See application file for complete search history.

(56) References Cited

U.S. PATENT DOCUMENTS 1,988,807 A * 1/1935 Pierson ..... F25C 5/043 24/265 BC
3,330,036 A * 7/1967 Marves ..... H02G 1/1224 29/828
4,215,871 A * 8/1980 Hirsch ..... B23B 31/1253 279/46.3
7,381,193 B2 6/2008 Nogami
2004/0143200 A1* 7/2004 Nogami ..... A61H 23/00 601/46

* cited by examiner

*Primary Examiner* — Kristen Matter
(74) *Attorney, Agent, or Firm* — Fish & Richardson P.C.

(57) ABSTRACT

The present disclosure provides a tuning fork handle assembly (hereinafter "assembly"). The assembly includes a substantially hollow body having an outer surface and an inner surface forming a cavity. An opening is formed at a first end of the body, and the cavity is flared at the first end of the body. The assembly also includes a spring member is disposed in the cavity at the first end such that the spring member fits into the flared end of the cavity. The spring member secures a tuning fork to the tuning fork handle responsive to engagement of the spring member. The assembly includes a cover disposed over the opening at the first end of the body. The cover includes an aperture configured to receive the tuning fork. The cover causes compression of at least a portion of the spring member to secure the tuning fork to the body of the tuning for handle.

20 Claims, 7 Drawing Sheets

TUNING FORK HANDLE ASSEMBLY

FIELD OF THE PRESENT DISCLOSURE

Aspects and implementations of the present disclosure relate to tuning fork handles, and more particularly, to a tuning fork handle assembly.

BACKGROUND OF THE PRESENT DISCLOSURE

Generally, tuning forks can function to provide therapy on a recipient's body. Specifically, the tuning fork is typically pointed at or touched on an area of the body, which needs healing. Vibrations created by the tuning fork are sent to nerve endings in the body, thereby transmitting a signal to parts of the body that is to undergo treatment.

SUMMARY OF THE PRESENT DISCLOSURE

Embodiments of the present disclosure provide a tuning fork handle assembly to consistently distribute vibrations caused by a tuning fork into a handle coupled to that tuning fork and onto a recipient's body. A recipient can be a person or an animal.

In one embodiment of the present disclosure, the tuning fork handle assembly includes a handle portion having a spring member therein to provide for consistent distribution of the vibrations in the handle.

In another embodiment of the present disclosure, the handle portion includes tips that transfer these vibrations to be extended throughout a body.

BRIEF DESCRIPTION OF THE DRAWINGS

The present disclosure will be more readily understood from the detailed description of exemplary embodiments presented below considered in conjunction with the attached drawings, of which.

It is noted that the drawings are intended to depict only typical or exemplary embodiments of the present disclosure and thus may not be necessarily to scale. Accordingly, the drawings should not be considered as limiting the scope of the present disclosure. The present disclosure will now be described in detail with reference to the accompanying drawings.

DETAILED DESCRIPTION OF THE PRESENT DISCLOSURE

Figure 1:
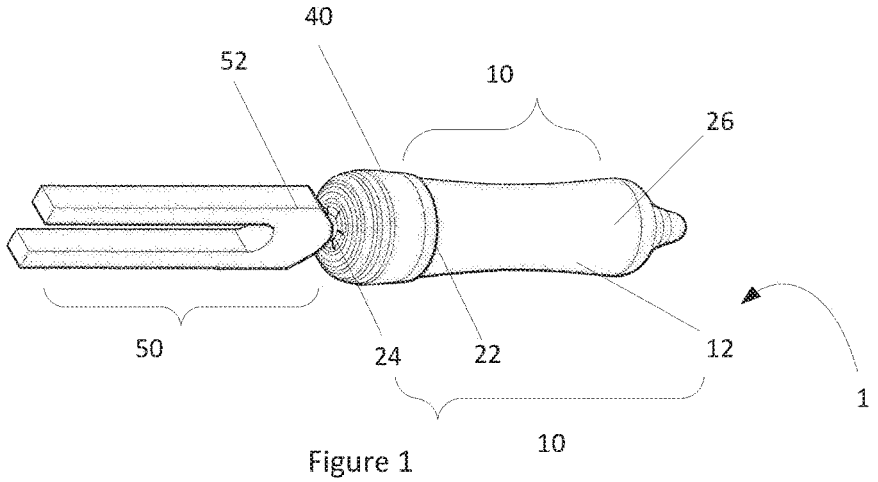
FIG. 1 is a schematic view of a tuning fork handle assembly in accordance with an embodiment of the present disclosure.

Aspects and implementations of the present disclosure relate to tuning fork handle assemblies that are adapted to securely accommodate and lock a tuning fork in order to enhance and distribute vibrations from the handle to various surfaces of a patients' body Referring to FIG. 1, there is shown a tuning fork handle assembly (hereinafter "assembly") 1 in accordance with an embodiment of the present disclosure. In one embodiment, the assembly 1 includes a handle 10 and a tuning fork 50.

Figure 1A:
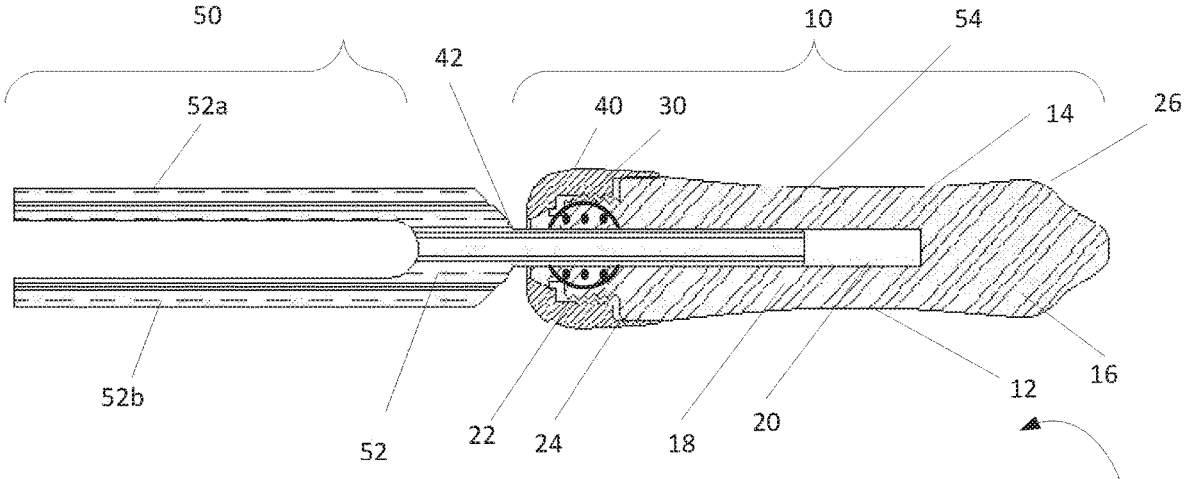
FIG. 1A is a cross-section view of the handle device of FIG. 1 in accordance with the embodiment of the present disclosure.

In one embodiment, the handle 10 may have substantially hollow cylindrical body 12 made of rigid materials such as metal, stone, wood, elastomeric, polymeric material or combinations of these materials. In one embodiment, the handle 10 is ergonomically designed to provide a user with maximum comfort while minimizing any physical problems associated with the use of the user's hands and wrists continuously in a repetitive motion. In one implementation, ergonomic design of the handle 10 is such that shape of the handle 10 designed to contour to the natural human grip. Such ergonomic design of the handle 10 provides an easeful, virtually effortless grip while preventing the assembly 1 from slipping out of user's hand. Such ergonomic design of the handle 10 prevents the user from compromising their body-mechanics and/or any potential injuries for extended periods of use. Some examples of the potential injuries may include straining one's muscles, tendons, ligaments, central nervous system and venous circulation. In one embodiment, a width of the handle 10 is in the range of 0.75 inches to 2.5 inches and length of the handle 10 is in the range of 4 inches to 8 inches. As shown in FIG. 1A, the body 12 has an outer surface 14 and an inner surface 16 forming a cavity 18 within the body 12. A slot 20 is formed within the body 12. The body 12 includes a first end 22 having an opening 24 and a second end 26, opposite the first end 22. The cavity 18 flares at the first end 22 of the body 12. ergonomic In one embodiment, FIG. 1A illustrates a tuning fork assembly 1A of which the handle 10 includes a spring member 30 securely disposed into the cavity 18 via the opening 24. As such, the spring member 30 surrounds a portion of the slot 20. In one embodiment, the handle 10 include a cover 40 that is shaped and sized to be inserted onto the first end of the body 12 to close the opening 24. The cover 40 can be made of materials, such as, metal, stone, wood, elastomeric, polymeric material or combinations of these materials. In one embodiment, the cover 40 is of ergonomic shape to allow a user to easily apply force to install the cover 40 onto the handle 10. In one implementation, ergonomic shape of the cover 40 is formed and sized to accommodate average size hand of a human. In one embodiment, the cover 40 functions to securely hold the spring member 30, which is described in greater detail below in conjunction with FIGS. 2, 2A, 3, 3A, 4 and 4A.

In one embodiment, the cover 40 can include an aperture 42 to accommodate the tuning fork 50, which is inserted into the slot 20 formed within the body 12. As shown in FIGS. 1 and 1A, the tuning fork 50 includes a vibrating element 52 with two tines 52*a* and 52*b* and a transmission rod 54. Although the vibrating element 52 as illustrated in FIGS. 1 and 1A is of U-Shape, one of ordinary skill will appreciate that the vibrating element 52 may be of other shapes such as rectangular, circular, square, etc. The transmission rod 54 is integrally formed or coupled to the vibrating element 52. The tuning fork 50 is coupled to the body 12 by inserting the transmission rod 54 into the body 12 via the aperture 42 of the cover 40, such that the transmission rod 54 is placed securely within the slot 20 formed within the body 12. Specifically, as illustrated in FIG. 1A, a portion of the transmission rod 54 is placed within the spring member 30, such that the spring member 30 compresses against the transmission rod 54. As such, the spring member 30 secures the tuning fork 50 to the handle 10 upon engagement of the spring member 30 with the transmission rod 54 of the handle 10. Accordingly, the spring member 30 causes the handle 10 to compress with the tuning fork 50 creating a seal as though the handle 10 and the tuning fork 50 are one continuous tool. The tuning fork 50 functions to cause vibrations at a frequency of in the range of 50 Hz to 200 Hz when the vibrating element 52 is hit against a surface or with an object. In one embodiment, vibrations from the tuning fork 50 are transmitted into the handle 10 from the first end 22 to the second end 26. Specifically, the vibrations magnify and intensify as they transmit through the handle 10. The handle 10 transmits and receives the vibrations from the vibrating element 52 of the tuning fork 50 through the transmission rod 54. As the vibrations are received by the handle 10, the handle 10 functions to amplify the vibrations (a.k.a. sound currents) by enhancing size and volume of the transmission rod 54. Further, the assembly 1 is securely tightened, which prevents chatter from decreasing quality of the vibrations. The handle 10 functions to transmit the vibrations to a recipient (e.g., person, animal) when the second end 26 of the handle 10 is pressed against affected areas of a recipient's body.

Figure 1B:
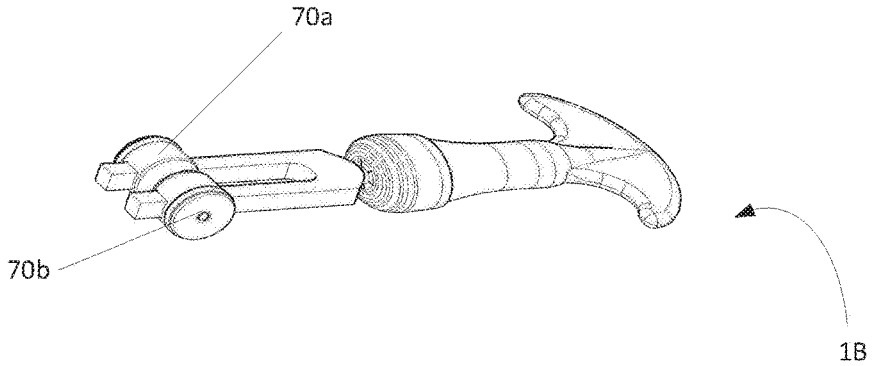
FIG. 1B is a schematic view of a tuning fork handle assembly in accordance with an embodiment of the present disclosure.

Referring to FIG. 1B, there is shown a tuning fork assembly 1B including a pair of weights 70*a* and 70*b* implemented onto the two tines 52*a* and 52*b* respectively of the tuning fork 50 in accordance with an embodiment of the present disclosure. In one embodiment, the pair of weights 70*a* and 70*b* help deepen the vibrations transmitted from the tuning fork 50 into the handle 10. In one embodiment, each of the pair of weights 70*a* and 70*b* weigh approximately 0.3 pound to 1 pound. In another embodiment, there are one or more weights coupled to the one or more of the tines.

Figure 2:
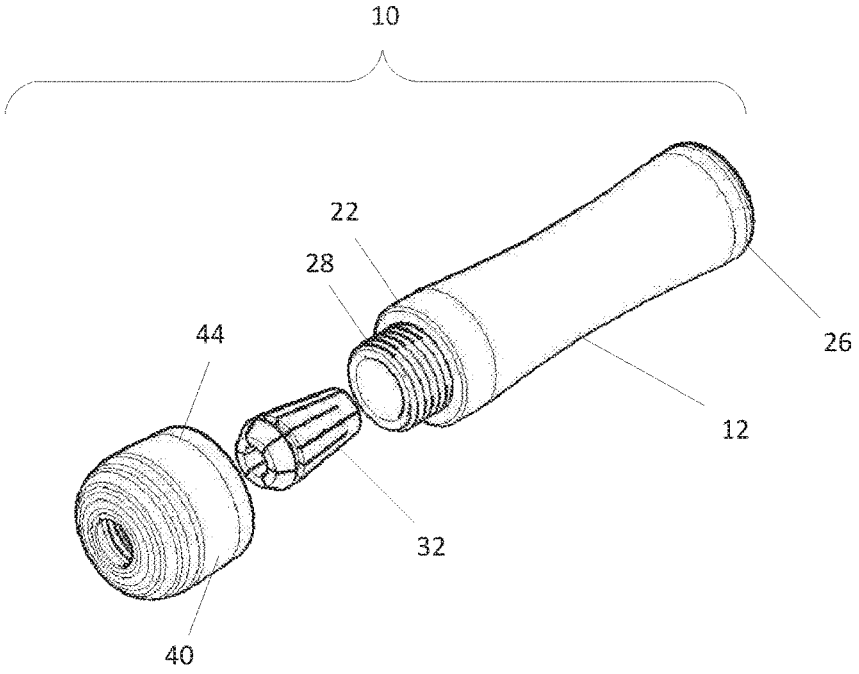
FIG. 2 is a schematic view of a tuning fork handle assembly in accordance with an embodiment of the present disclosure.
Figure 2A:
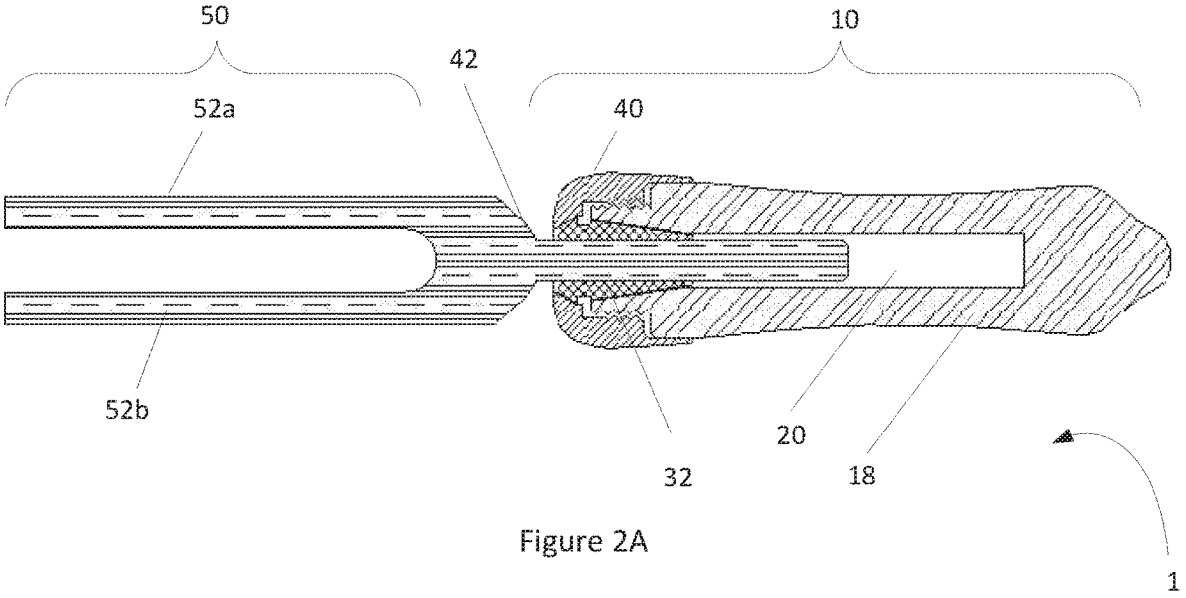
FIG. 2A is a cross-section view of the handle device of FIG. 2 in accordance with the embodiment of the present disclosure.

Referring to FIGS. 2 and 2A there is shown the handle 10 with its corresponding elements in accordance with an embodiment of the present disclosure. In one embodiment, the body 12 includes a threaded portion 28 at the first end 22. In one embodiment, the spring member 30 includes a spring collet 32. The spring collet 32 can be made of a metal such with one or more grooves along its length to allow the spring collet 32 to expand and contract. The spring collet 32 can be disposed inside the cavity 18, such that the spring collet 32 surrounds a portion of the slot 20. In one embodiment, the cover 40 includes a threaded portion 44. The cover 40 is disposed on top of the first end 22 of the body such that the threaded portion 44 of the cover is fitted with the threaded portion 28 of the first end 22. The cover 40 is turned which causes the spring collet 32 to compress resulting in the spring collet 32 to be disposed securely inside the cover 40. As such, the cover 40 functions to securely hold the spring collet 32 in its place in order to maintain and spread the vibrations from the tuning fork 50 into the entire body 12 of the handle 10. The cover 40 places the whole assembly 1 together, which results in maintaining and spreading of the vibrations from the tuning fork 50 into the entire body 12 of the handle 10.

Figure 3:
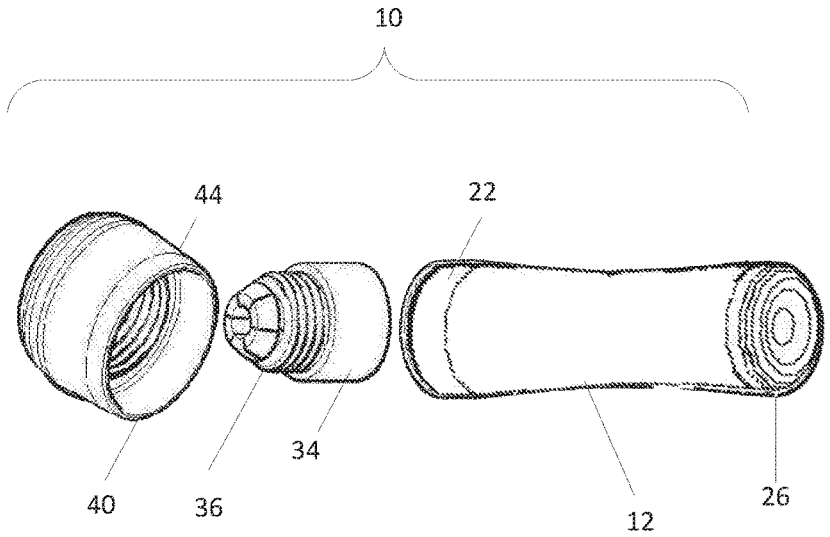
FIG. 3 is a schematic view of a tuning fork handle assembly in accordance with an embodiment of the present disclosure.
Figure 3A:
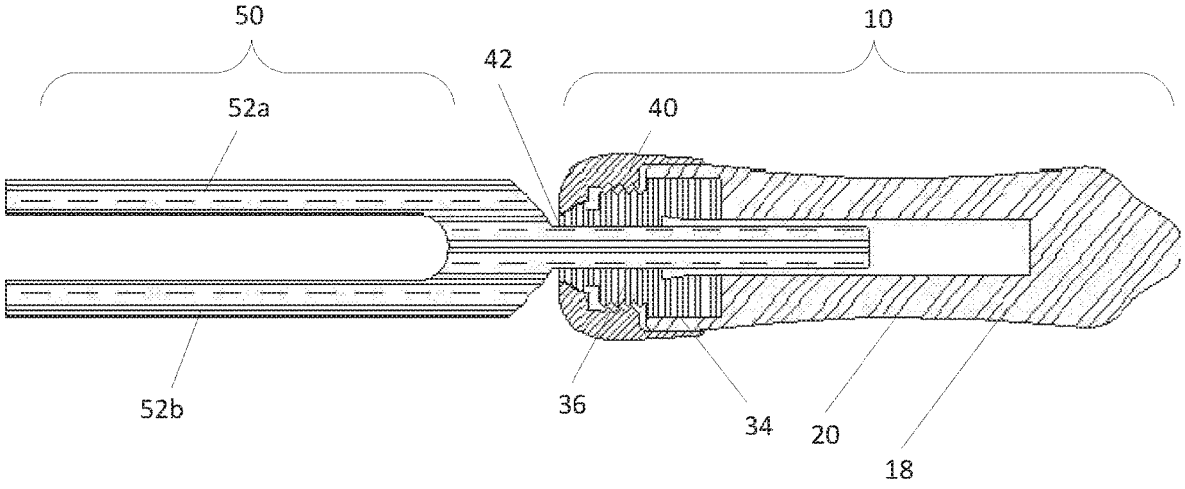
FIG. 3A is a cross-section view of the handle device of FIG. 3 in accordance with the embodiment of the present disclosure.

Referring to FIGS. 3 and 3A there is shown the handle 10 with its corresponding elements in accordance with an embodiment of the present disclosure. In one embodiment, the spring member 30 includes a first bushing 34 having a spring integrated within the first bushing 34. The first bushing 34 can be made from materials, such as, metal, stone, steel, rubber, plastic, etc., or combinations of these materials. The first bushing 34 can be disposed inside the cavity 18 surrounding a portion of the slot 20. The first bushing 34 can include a threaded portion 36, such that, when the first bushing 34 is inserted into the cavity 18, the threaded portion 36 of the first bushing 34 projects outward from the body 12 at the first end 22. As discussed above, the cover 40 includes a threaded portion 44. The cover 40 is disposed on top of the first end 22 of the body such that the threaded portion 44 of the cover is fitted with the threaded portion 28 of the first end 22. The cover 40 is turned which causes the first bushing 34 to compress resulting in the first bushing 34 to be disposed securely inside the cover 40. As such, the cover 40 functions to securely hold the first bushing 34 in its place in order to maintain and spread the vibrations from the tuning fork 50 into the entire body 12 of the handle 10. As discussed above, the cover 40 places the whole assembly 1 together, which results in maintaining and spreading of the vibrations from the tuning fork 50 into the entire body 12 of the handle 10.

Figure 4:
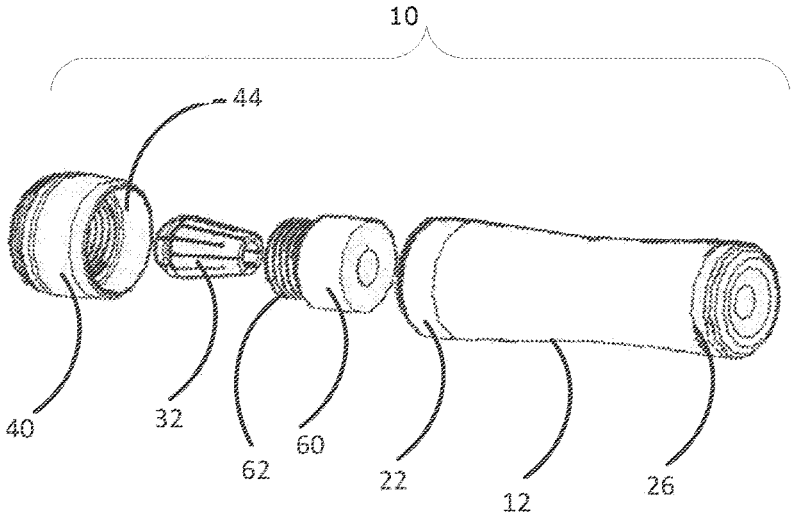
FIG. 4 is a schematic view of a tuning fork handle assembly in accordance with an embodiment of the present disclosure.
Figure 4A:
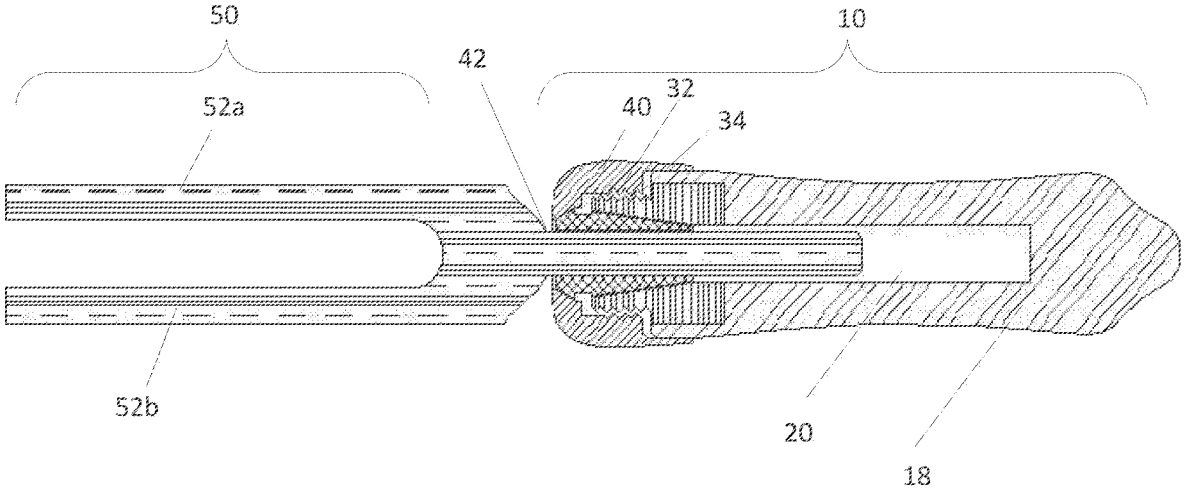
FIG. 4A is a cross-section view of the handle device of FIG. 4 in accordance with the embodiment of the present disclosure.

Referring to FIGS. 4 and 4A there is shown the handle 10 with its corresponding elements in accordance with an embodiment of the present disclosure. In one embodiment, the handle 10 includes a second bushing 60. The second bushing can be placed inside the cavity 18 surrounding a portion of the slot 20. The second bushing 60 can be made from materials, such as, metal, stone, steel, rubber, plastic, etc. or combinations of these materials. The second bushing 60 can include a threaded portion 62, such that, when the second bushing 60 is inserted into the cavity 18, the threaded portion 62 of the second bushing 60 projects outward from the body 12 at the first end 22. In one embodiment, the spring member 30 includes the spring collet 32. As discussed above, the spring collet 32 can be made of spring steel with one or more grooves along its length to allow it to expand and contract. The spring collet 32 can be placed inside the second bushing 60. As discussed above, the cover 40 includes a threaded portion 44. In one embodiment, the cover 40 includes a threaded portion 44. The cover 40 is disposed on top of the first end 22 of the body such that the threaded portion 44 of the cover is fitted with the threaded portion 28 of the first end 22. The cover 40 is turned which causes the second bushing 60 to compress resulting in the second bushing 60 including the spring collet 32 to be disposed securely inside the cover 40. As such, the cover 40 functions to securely hold the second bushing 60 including the spring collet 32 in its place in order to maintain and spread the vibrations from the tuning fork 50 into the entire body 12 of the handle 10. As discussed above, the cover 40 places the whole assembly 1 together, which results in maintaining and spreading of the vibrations from the tuning fork 50 into the entire body 12 of the handle 10.

Figure 5:
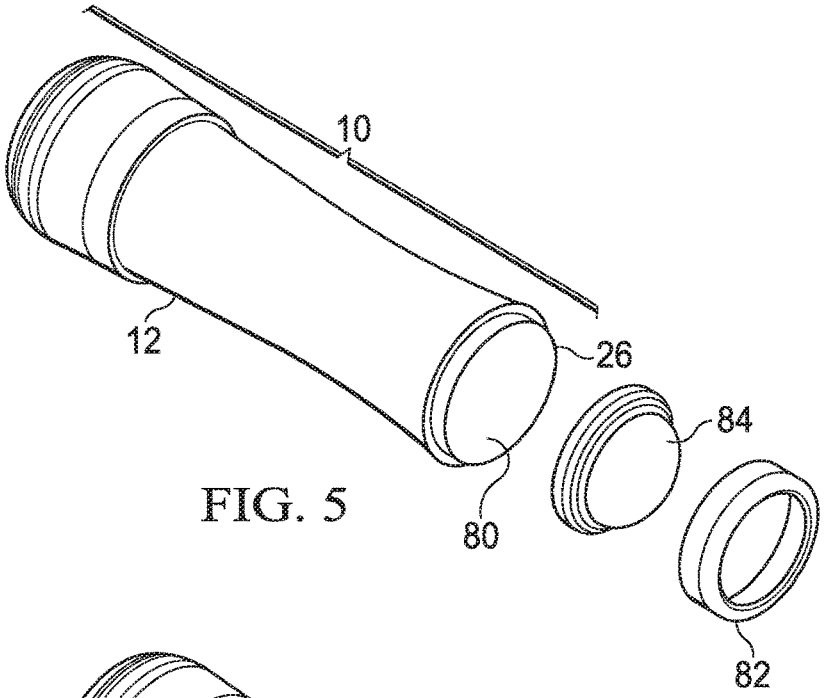
FIG. 5 is a schematic view of a tuning fork handle assembly in accordance with an embodiment of the present disclosure.

As shown in FIG. 5, in one embodiment, the handle 10 includes a tip 80 affixed to the second end 26 of the body 12. In one embodiment, the tip 80 is integrally formed at the second end 26 of the body 12. As discussed above, the vibrations from the tuning fork 50 are transmitted into the handle 10. More specifically, the vibrations from the tuning fork 50 are transmitted from the first end 22 to the second end 26 of the body 12 into the tip 80. In one embodiment, the tip 80 is made of the same material as the body 12 of the handle 10. The tip 80 can be made of any material as long the tip 80 functions to transmit the vibration therefrom when pressed against the affected area either directly or indirectly with a piece of a material. As such, as the tip 80 is pressed against affected areas of a recipient, the vibrations work on the affected areas resulting in various curing effects.

In one embodiment, the tip 80 can be removable from the body 12 and is interchangeable, such that, different types of tips 80 can be coupled to the second end 26 of the body 12. In one embodiment, the assembly 1 includes a through hole cap 82 that can be coupled onto the second end 26 of the body 12 to assist in securing the tip 80 onto the body 12. In one embodiment, the assembly 1 includes a cap 84 that can be coupled onto the second end 26 of the body 12 to assist in securing the tip 80 onto the body 12. In one embodiment, the assembly 1 includes a combination of the hole cap 82 and the cap 84, which can be coupled onto the second end 26 of the body 12 to assist in securing the tip 80 onto the body 12.

Figure 5A:
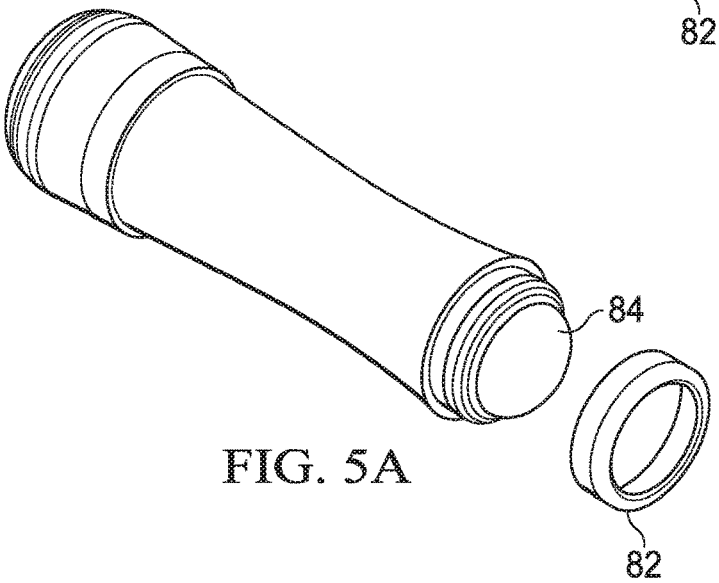
FIG. 5A is a schematic view of a tuning fork handle assembly of FIG. 5 in accordance with an embodiment of the present disclosure.
Figure 5B:
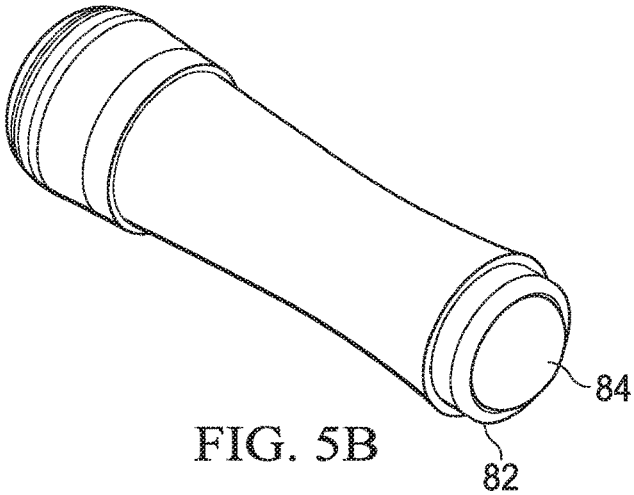
FIG. 5B is a schematic view of a tuning fork handle assembly of FIG. 5 in accordance with an embodiment of the present disclosure.

As illustrated in FIG. 5A, the assembly 1 includes a cap 84 coupled onto the second end 26 of the body 12. As illustrated in FIG. 5B, the assembly 1 includes a combination of the hole cap 82 and the cap 84, which can be coupled onto the second end 26 of the body 12.

In one embodiment, the tip 80 can have variety of different shapes as illustrated in FIGS. 5C-5H.

Figure 5C:
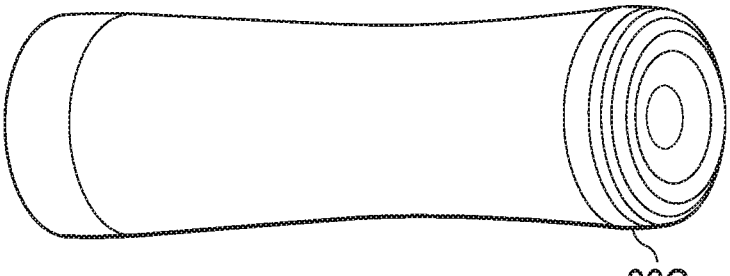
FIG. 5C is a schematic view of a tuning fork handle assembly of FIG. 5 in accordance with an embodiment of the present disclosure.

FIG. 5C illustrates the tip 80C shaped in a substantially concave configuration. In one embodiment, the tuning fork assembly 1 having the tip 80C with the substantially concave configuration can be applied towards a recipient's joints, such as, elbows, knees, skull behind the ear or any other areas with joints in a human or animal body.

Figure 5D:
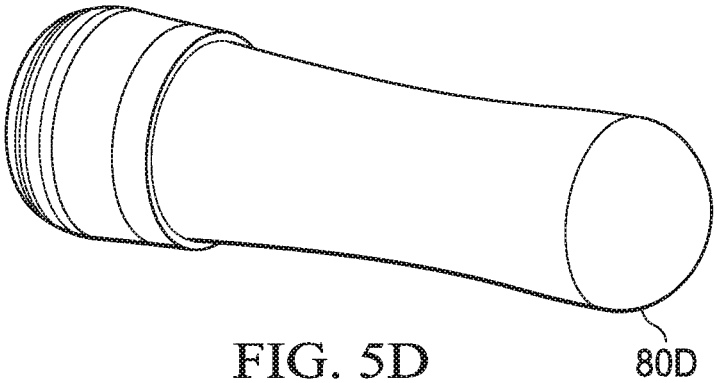
FIG. 5D is a schematic view of a tuning fork handle assembly of FIG. 5 in accordance with an embodiment of the present disclosure.

FIG. 5D illustrates the tip 80D shaped in a substantially convex configuration. In one embodiment, the tuning fork assembly 1 having the tip 80D with the substantially convex configuration can be applied towards a larger muscle bodies or larger and deeper crevasses throughout a recipient's body parts such as forearms, upper legs, lower legs, chest, back and neck.

Figure 5E:
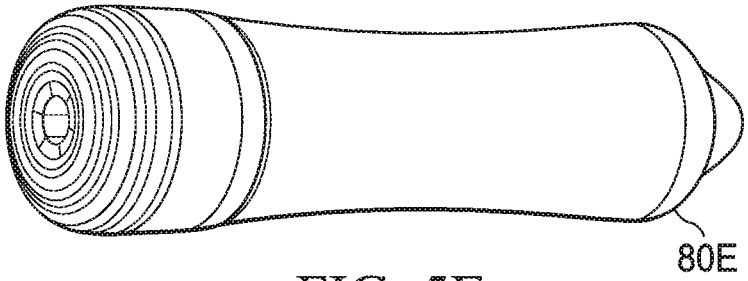
FIG. 5E is a schematic view of a tuning fork handle assembly of FIG. 5 in accordance with an embodiment of the present disclosure.

FIG. 5E illustrates the tip 80E shaped in a substantially medium point configuration. In one embodiment, the tuning fork assembly 1 having the tip 80E with the substantially medium point configuration may be applied towards finer grooves in the human or animal body.

Figure 5F:
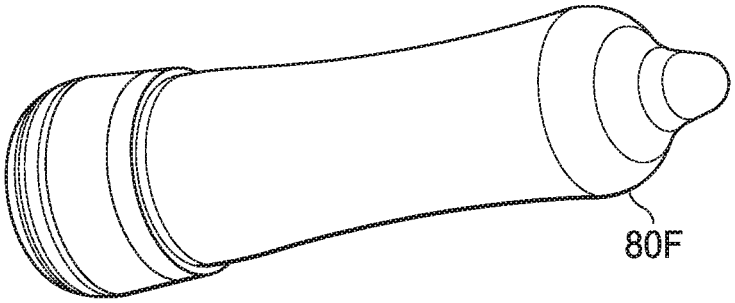
FIG. 5F is a schematic view of a tuning fork handle assembly of FIG. 5 in accordance with an embodiment of the present disclosure.

FIG. 5F illustrates the tip 80F shaped in a substantially fine point configuration. In one embodiment, the tuning fork assembly 1 having the tip 80F with the substantially fine point configuration can be applied towards small crevasses of the hand and also may be used on acupressure points and deep muscle attachments throughout the entire skeletal system of the recipient body.

Figure 5G:
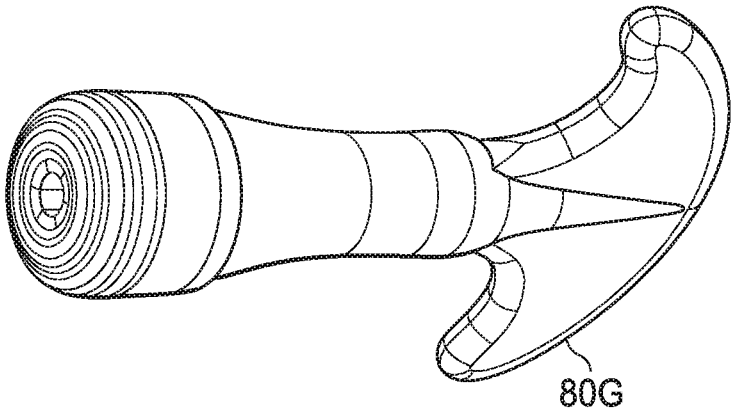
FIG. 5G is a schematic view of a tuning fork handle assembly of FIG. 5 in accordance with an embodiment of the present disclosure.

FIG. 5G illustrates the tip 80G shaped in a substantially broad edge configuration. In one embodiment, the tuning fork assembly 1 having the tip 80G with the substantially broad edge configuration may be applied towards broad strokes along the superficial (topical) aspects of the recipient's body (such as upper arm), for example circulating lymph through the lymph system. The tip 80G with the substantially broad edge configuration may also be applied towards longer crevasses throughout the recipient body (such as lower arm). The tip 80G with the substantially broad edge configuration may also be designed to be placed on acupuncture points during an acupressure treatment.

Figure 5H:
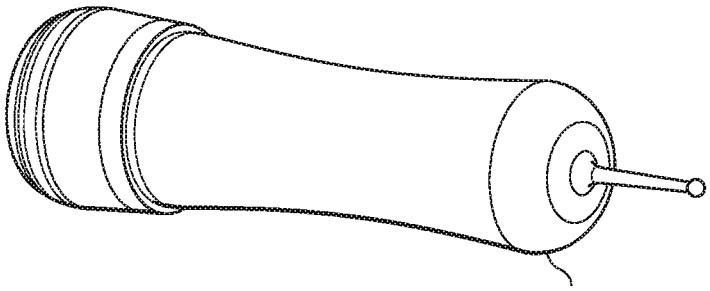
FIG. 5H is a schematic view of a tuning fork handle assembly of FIG. 5 in accordance with an embodiment of the present disclosure.

FIG. 5H illustrates the tip 80H shaped in a substantially needlepoint configuration. In one embodiment, the tuning fork assembly 1 having the tip 80H with the substantially needlepoint configuration may be applied towards precise points in the human or animal body that require acupressure.

It will be appreciated by those skilled in the art that changes could be made to the embodiments described above without departing from the broad inventive concept thereof. It will be understood, therefore, that this present disclosure is not limited to the particular embodiments disclosed, but is intended to cover modifications within the spirit and scope of the present disclosure as defined by the appended claims.

What is claimed is:

1. A tuning fork and tuning fork handle assembly comprising:

a substantially hollow body having an outer surface, a first end, a second end and an inner surface forming a cavity, wherein an opening is formed at the first end of the body along a central axis of the body, the cavity is flared at the first end of the body, and the second end of cavity terminates prior to the second end of the substantially hollow body;

a spring member disposed in the cavity at the first end, wherein the spring member fits into the flared end of the cavity, and wherein the spring member secures the tuning fork to the body responsive to engagement of a collet; and a cover disposed over the opening at the first end of the body, wherein the cover comprises an aperture that receives the tuning fork, and wherein the cover causes compression of at least a portion of the spring member to secure the tuning fork to the body of the tuning fork handle.

2. The tuning fork handle assembly of claim 1, wherein the body comprises a first threaded portion at the first end of the body and the cover comprises a second threaded portion such that the second threaded portion is fitted with the first threaded portion upon insertion of the cover onto the first end of the body.

3. The tuning fork handle assembly of claim 2, wherein the collet has one or more grooves.

4. The tuning fork handle assembly of claim 3 wherein the cover is turned causing the collet to compress such that the collet rests securely inside the cover.

5. The tuning fork handle assembly of claim 2 wherein the cover comprises a second threaded portion.

6. The tuning fork handle assembly of claim 5, wherein the spring member comprising a first bushing with an integrated spring, wherein the first bushing comprises a third threaded portion.

7. The tuning fork handle assembly of claim 6 wherein the first bushing is inserted securely into the cavity of the body such that the third threaded portion of the first bushing projects outward from the body at the first end.

8. The tuning fork handle assembly of claim 7 wherein the cover is turned to fit the second threaded portion of the cover with the third threaded portion of the first bushing upon insertion of the cover onto the first end of the body, wherein the turning of the cover causes the first bushing to compress such that the first bushing rests securely inside the cover.

9. The tuning fork handle assembly of claim 6 wherein the first bushing comprises one of a metal, stone, steel, rubber or plastic material.

10. The tuning fork handle assembly of claim 6 further comprising a second bushing, wherein the second bushing comprises a fourth threaded portion inserted securely into the cavity of the body such that the fourth threaded portion of the second bushing projects outward from the body at the first end.

11. The tuning fork handle assembly of claim 10 wherein collet is securely placed inside the second bushing, wherein the collet comprises one or more grooves.

12. The tuning fork handle assembly of claim 11 wherein the second bushing is inserted securely into the cavity of the body such that the fourth threaded portion of the second bushing projects outward from the body at the first end.

13. The tuning fork handle assembly of claim 12 wherein the cover is turned to fit the threaded portion of the cover with the fourth threaded portion of the second bushing upon insertion of the cover onto the first end of the body, wherein the turning of the cover causes the second bushing and the collet to compress such that the second bushing and the collet rests securely inside the cover.

14. The tuning fork handle assembly of claim 1, wherein the body comprises a second end opposing the first end, wherein the second end of the body comprising a tip, wherein the tip is removable from the body.

15. The tuning fork handle assembly of claim 14 wherein the tip is one of a substantially concave configuration, a substantially convex configuration, a substantially point configuration or a substantially broad edge configuration.

16. The tuning fork handle assembly of claim 1 wherein the body and the cover comprises of an ergonomic shape.

17. The tuning fork handle assembly of claim 1 wherein the tuning fork comprises a vibrating element and a transmission rod is coupled to the vibrating element.

18. The tuning fork handle assembly of claim 17 wherein the transmission rod is inserted into the body via the aperture of the cover to securely place the transmission rod within a slot.

19. The tuning fork assembly of claim 17 wherein vibrating element comprises a U-shaped element having two tines.

20. The tuning fork assembly of claim 19 wherein a weight is placed on at least one of the two tines.

* * * * *